United States Patent [19]

Gérard

[11] Patent Number: 4,511,777

[45] Date of Patent: Apr. 16, 1985

[54] PERMANENT MAGNET THERMAL ENERGY SYSTEM

[76] Inventor: Frank Gérard, 12020 Brooknoll Dr., Kingsville, Md. 21087

[21] Appl. No.: 632,287

[22] Filed: Jul. 19, 1984

[51] Int. Cl.[3] ..... H05B 6/10

[52] U.S. Cl. ..... 219/10.51; 219/10.49 R; 219/10.65; 219/10.79

[58] Field of Search ..... 219/10.51, 10.49 R, 219/10.65, 10.57, 10.79, 10.75

[56] References Cited

U.S. PATENT DOCUMENTS

| | | | |
|---|---|---|---|
| 1,577,276 | 3/1926 | Whitten | 219/10.51 |
| 2,171,080 | 8/1939 | Ely | 219/10.51 |
| 2,218,999 | 10/1940 | White | 219/10.51 |
| 2,635,168 | 4/1953 | Lerza et al. | 219/10.49 R |
| 2,912,552 | 11/1959 | Baermann | 219/10.49 |
| 3,272,956 | 9/1966 | Baermann | 219/10.49 |
| 4,217,475 | 8/1980 | Hagerty | 219/10.51 |
| 4,341,936 | 7/1982 | Virgin | 219/10.51 |

FOREIGN PATENT DOCUMENTS

| | | | |
|---|---|---|---|
| 461483 | 7/1975 | U.S.S.R. | 219/10.51 |

*Primary Examiner*—Philip H. Leung
*Attorney, Agent, or Firm*—John F. McClellan, Sr.

[57] ABSTRACT

An improved rotary magnet thermal generator system of the type having an array of magnets in alternating disposition coaxially disposed about and parallel with the shaft of a motor driving the rotary array and having a copper heat absorber and a ferro-magnetic plate fixed on a face of the heat absorber, includes as efficiency improver a plurality of heat sink plates extending beyond the ferro-magnet plate into a plenum through a respective plurality of close-fitting apertures. In a further embodiment the heat sink plates are in thermal contact with sinusoidally convoluted tubing that both increases surface area and provides for optional heating of gases and/or fluids at the same time.

7 Claims, 4 Drawing Figures

PERMANENT MAGNET THERMAL ENERGY SYSTEM

FIELD OF THE INVENTION

This invention relates generally to employment of magnetic flux, and particularly of permanent magnet flux fields to generate thermal energy.

BACKGROUND OF THE INVENTION

Known apparatus for heating using rotating magnets and material acted on by them for heat producing purposes include the following U.S. patents:

No. 2,912,552 to M. Baerman shows embodiments in which magnet arrays are passed by laminated pole pieces edge-on to the magnets, and also are passed by laminates of metal sheets perpendicular to the metal sheets;

No. 3,272,956 to M. Baerman, 9-13-66, shows apparatus for heating elongate material with magnets; and No. 4,217,475 to J. P. Hagerty, 8-12-80, shows fluid heating magnet apparatus with sleeves.

SUMMARY OF THE INVENTION

An object of this invention is to produce pollution free heat energy in a way that is more efficient than prior apparatus, and that provides for the heat energy to be conveniently and safely radiated or conducted or convected, for use. The preferred embodiment is to be used in conductive heating of fluids that are circulated to transfer the heat to use-locations. The fluids may be water or the like, or gases such as air.

Further objects are to provide an improved system for producing heat from electric current flow in conductive material by change of magnetic flux with time, in the form of symmetrical rotating-permanent-magnet apparatus having north-south-north-south polarity series coacting with adjacently located conductive material to effect desired cyclical molecular motion.

The system of this invention functions primarily by employing the magnetic flux field of rotated permanent magnets to produce thermal effects or heat energy. As noted, heat energy generated may be radiated, conducted or convected for use; liquids or gases as well as solids may be employed in the heat transfer. The present embodiment employs in addition to the rotating magnet assembly, a plenum system, that it heats and that transfers the heat to fluids or other substances to be heated.

In more detail, the rotor portion of the apparatus, is, according to the invention, used to cause attractions and repulsions of molecules in the presence of alternating permanent magnet flux fields. The magnetic flux fields are from permanent magnets arranged in alternate north-south-north-south polarity sequence to impress regular alternating motion on the random motion of the molecules. For this, elongate permanent magnets are fixed in an axis-centered circle on a ferrous rotor back plate, parallel to the axis of rotation. A first end or pole of each permanent magnet is in contact with a rotor back plate and a second end or pole of each permanent magnet is in equally spaced relation relative to the other permanent magnets to a heat absorbing plate. The polarity of the permanent magnets is alternated in the fixed succession or series.

The rotor is circular preferably. A cover or front plate of substantially non-magnetic stainless steel covers the second ends of the magnets. Inside the rotor the spaces around the magnets and between the front and back plates generally are filled with "Ensor Rock" or any othe suitable commercial fire brick type tenacious high-temperature insulative material.

A stainless steel shaft mounts the rotor between pillow blocks, and a motor rotates the shaft.

The portion of the apparatus to be heated for heat transfer includes in a preferred embodiment a plenum with a wall formed of a plate of copper, the absorber plate a ferromagnetic plate or keeper plate on the copper plate; side and end walls, and a plurality of heat sink plates extending beyond the ferro-magnetic plate into the plenum. As a preferred part of the system, a blower is provided to pass air for heating through the plenum, and in an alternative embodiment, tubing affixed in thermal contact with the heat sink plates is provided to heat fluid such as water passed through the tubing.

Temperature is proportional, among other things, to speed of rotor, flux field traversed per revolution, strength of flux field; material, design and mass and area of the heat absorber plate and the ferro-magnetic plate, to be described in detail, and of mass of material heated and of flow rate and initially temperature of material heated. If desired, for the purpose of design and construction, the permanent magnets may be stationary and the heat absorber plate may be rotated to achieve the same thermal effect but this is not preferred for the embodiment described. Electro-magnets may be used but permanent magnets are preferred for simplicity and economy and durability.

BRIEF DESCRIPTION OF THE DRAWINGS

The above and other objects and advantages of this invention will become more readily apparent on examination of the following description, including the drawings in which like reference numerals refer to like parts. The drawings are not to scale and are generally diagrammatic.

DETAILED DESCRIPTION

Figure 1:
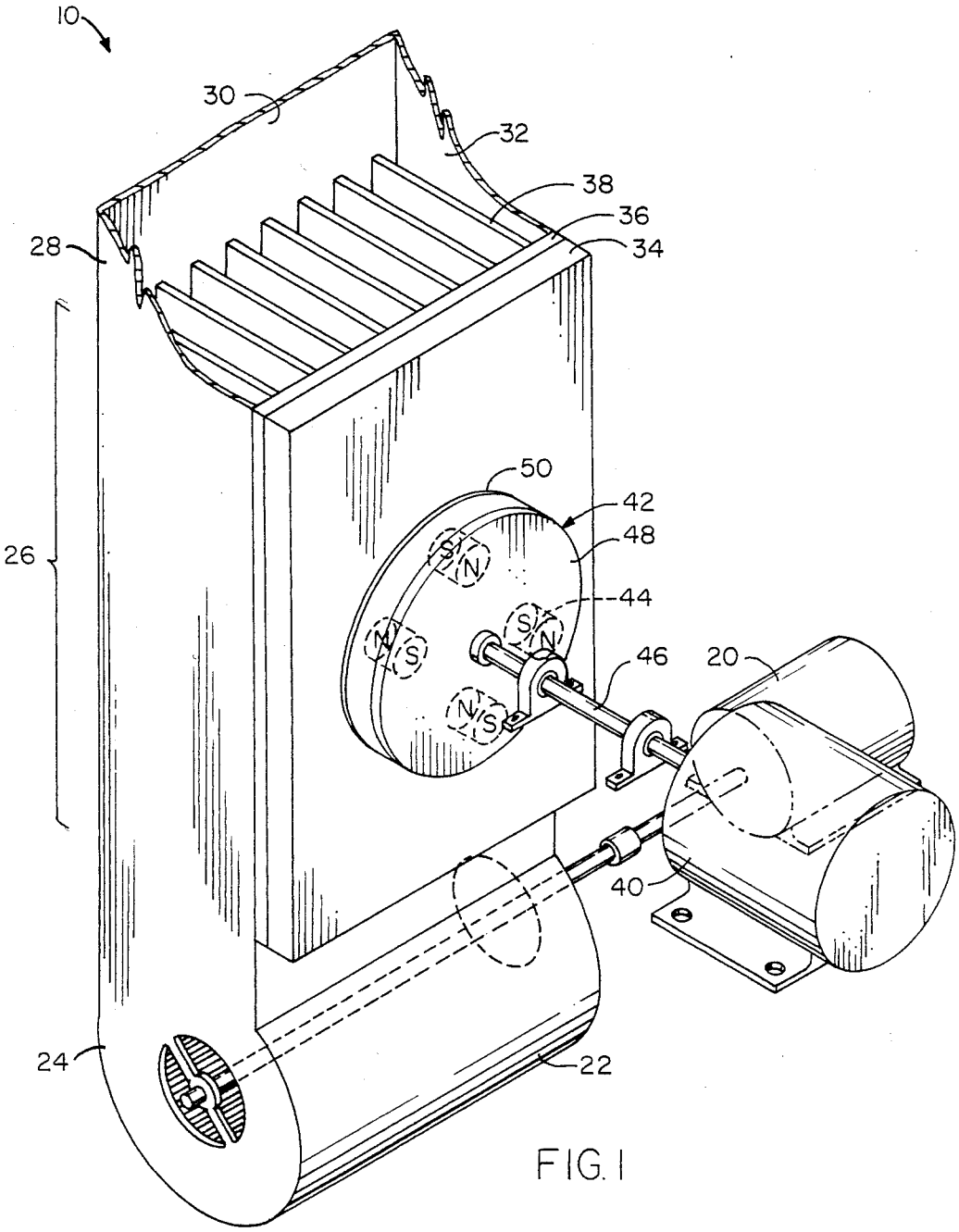
FIG. 1 is a partially broken away and partially exploded perspective detail of apparatus of the type disclosed herein.

FIG. 1 diagrams an exterior view of preferred embodiment 10 of the invention, a pollution-free hot air furnace.

Blower motor 20 drives a blower 22 to force air through a duct system 24 that includes a plenum 26, where the air is heated and passes on to the location at which hot air is used. It will be appreciated that the blower could as well be located to draw air through the system, and also that the system could be any suitable closed system or open system, as desired.

Superficially described, the plenum may comprise, on three sides, duct walls 28, 30, 32. The front wall is omitted, for exposition. These may be of aluminum. On the fourth side is a heat absorber plate 34 of copper, and on the plenum side of that a condensing plate or ferro-magnetic plate 36 of the same height and width. Extending beyond the ferro-magnetic plate into the plenum, are a plurality of parallel heat sinks 38, of copper, aligned with the direction of airflow.

To heat the air flowing through the plenum, a second electric motor 40 rotates a motor 42, an array of magnets 44 mounted in a disk-shaped holder fixed coaxially on the end of preferably stainless steel motorshaft 46 in closely spaced relation to the outer face of the heat absorber plate 34.

The rotor 42 includes mounted in it between a ferro-magnetic back plage 48 and a stainless steel front plate 50, an even number of the elongate magnets 44 fixed in a circle parallel with each other and coaxial with the motor shaft. Every second magnet has the north pole at the front plate and the remaining magnets have the south pole at the front plate, as indicated.

As a result of the inventor's experimenting with the apparatus in perfecting this invention, he discovered means yielding a surprising improvement efficiency.

The copper heat sinks are plates. They heat very slowly regardless of speed of revolution of the rotor, if the ferro-magnetic plate is a continuous plate as FIG. 1 might imply it is.

A most surprising result, in the form of heat-sink heating occurs when the apparatus is modified, as indicated in the next Figure.

Figure 2:
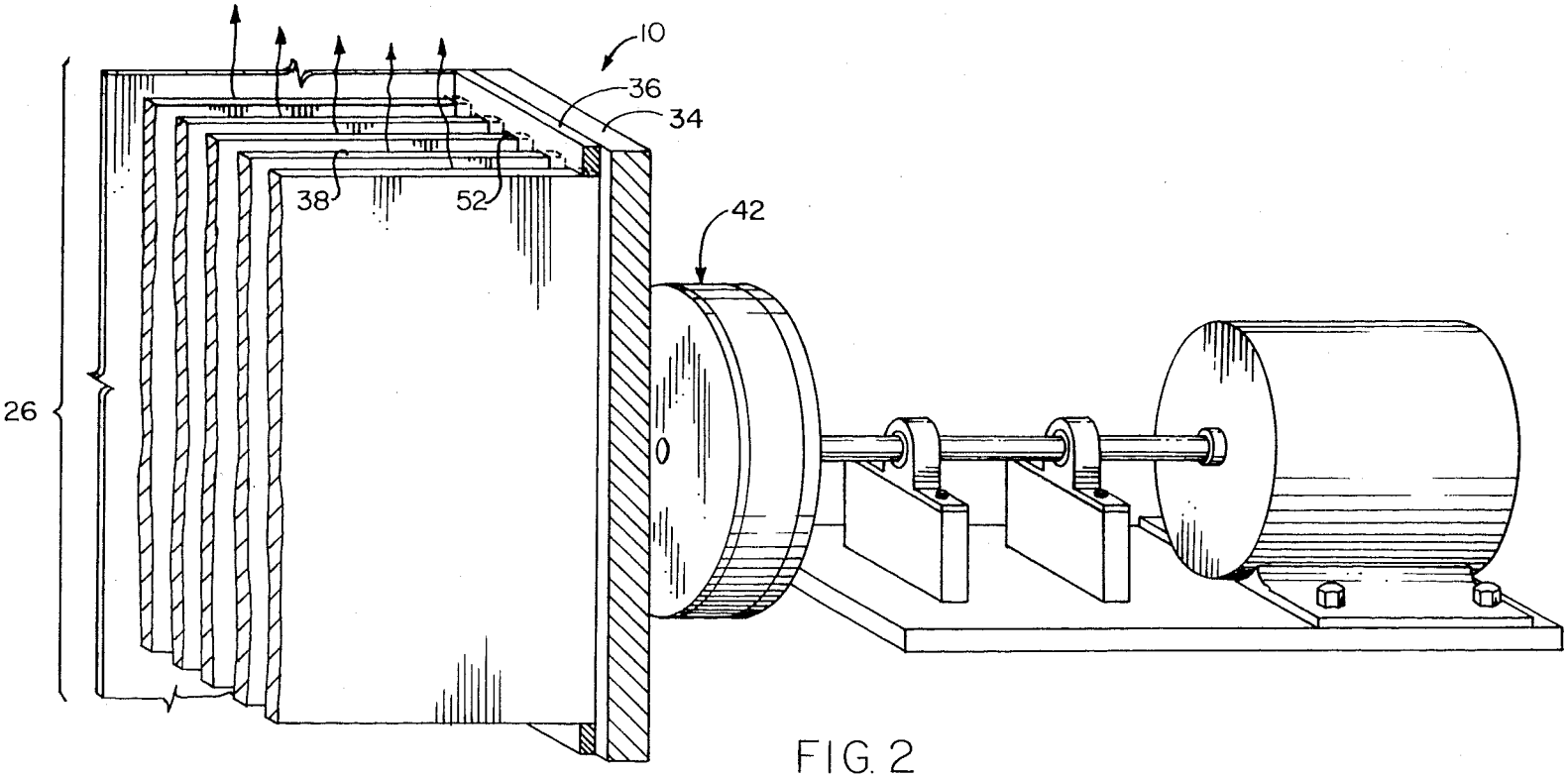
FIG. 2 is a perspective detail partly broken away to show internal construction.

FIG. 2 shows the modification according to the diiscovery.

If a close fitting opening 52 is made in the ferro-magnetic plate 36 for each heat-sink 38 to pass through and integrally join the heat absorber plate 34 instead of being supported by the ferro-magnetic plate, heating developed by the mechanism is out of all proportion to that developed with the continuous ferro-magnetic plate.

As an example, with the same size apparatus, the continuous or solid ferro-magnetic plate embodiment failed to make the heat-sinks hot to the touch after twenty-one minutes of rotation of the rotor at 1225 RPM. During this period the motor required 7 amps to turn the rotor.

Selection of the thickness of the ferro-magnetic plate is done experimentally by measuring, on the heat-sink-plate side of the ferro-magnetic plate for leakage of magnetic flux, and minimizing the leakage by increasing the ferro-magnetic plate thickness.

In contrast, with the plates of the heat sinks 38 protruding through the ferro-magnetic plate 36 the heat sink plates instantly became hot to the touch and, under the same conditions, twenty-one minutes of rotation of the rotor 42 at 1725 RPM, requiring as before, 7 amps, the heat sink plate temperature was 212 F.

Function of the perforate ferro-magnetic plate is believed to be that of better defining the magnetic field, but the surprising results are not clearly understood. Lower heat transfer through the ferro-magnetic plate than directly from the copper heat absorber plate into the heat sink plates probably contributes, to some extent, to the better performance. Clearance at the openings 52 may be just sufficient for assembly, preferably. With the same airflow, air temperature exhausted from the plenum 26 is about 185° F. to 190° F. with the perforate ferro-magnetic plate 36 and about 110° F. to 115° F. with a continuous ferro-magnetic plate. Eventually the second arrangement will come up to temperature but it takes more than twice as long.

Figure 3:
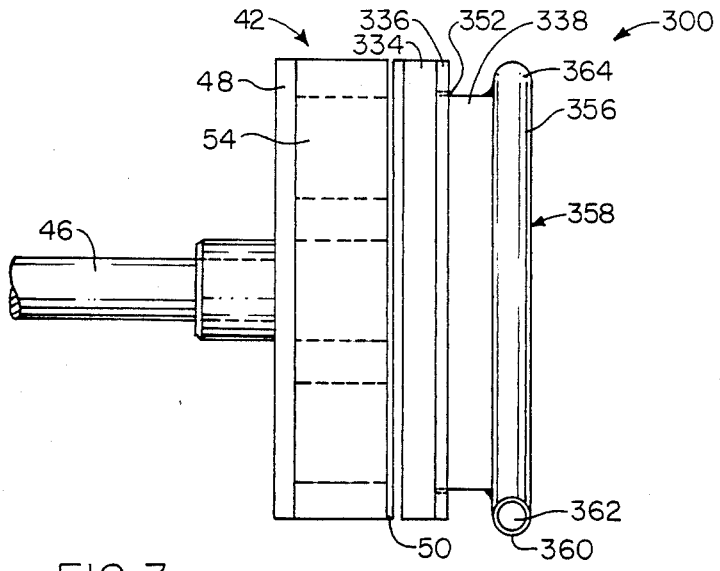
FIG. 3 is a side elevational detail of a second embodiment.

FIG. 3 shows a detail of embodiment 300 of the invention. In this embodiment the details of the motor drive shaft 46 carrying the magnet assembly or rotor 42 are the same as before. Back plate 48 and front plate 50 carry between them the circular array of magnets in alternating polarity arrangement, embedded in "Ensor Rock" 54 or other high-temperature cementitious material.

Spaced about two or theee millimeters from the front plate 50 is copper heat absorber plate 334 fixed-in-place by any suitable means.

The plenum-side face of the heat absorber plate 334 is covered by ferro-magnetic plate 336 or condensor plate. Through a corresponding set of close-fitting slots 352 in the ferro-magnetic plate 336 protrude, from integral affixation to the heat absorber plate, a plurality of heat sink plates 338. Fixed in intimate thermal contact, as by soldering or brazing, to the free ends of the heat sink plates 338 are respective runs 356 of a convoluted copper tubing manifold 358. "U"-shaped 180° curves 360 return the tubing at the upper and lower edges of the heat sink plates. Intake 362 and discharge 364 are conventionally arranged.

Figure 4:
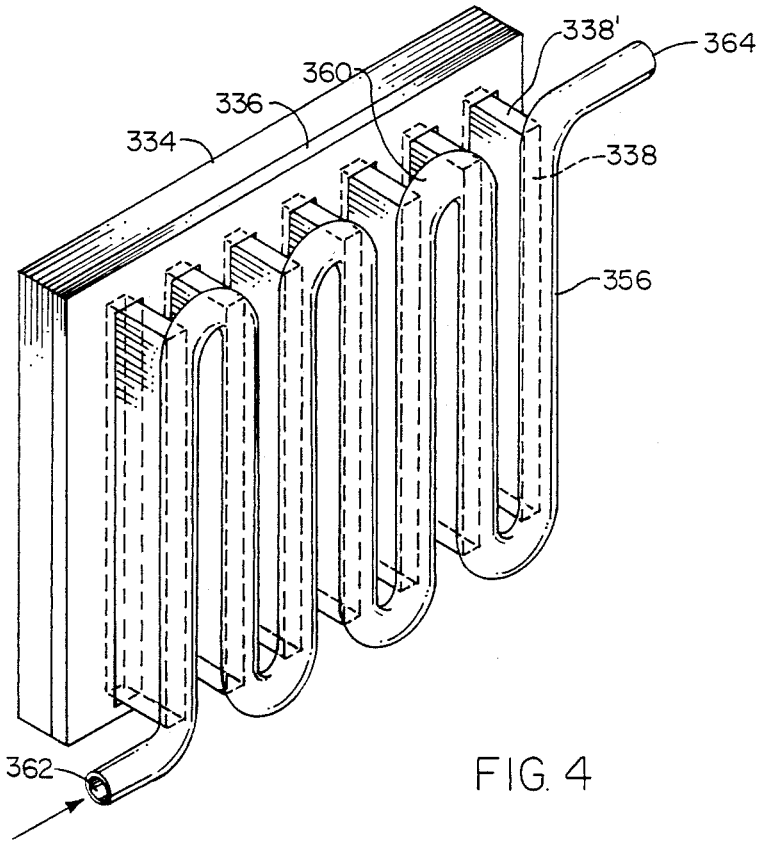
FIG. 4 is a perspective detail of the second embodiment.

FIG. 4 shows in perspective view the relation of the runs 356 of sinusoidally convoluted tubing manifold to the free ends 338' of the heat sink plates 338. Heat absorption plate appears at 334 and ferro-magnetic plate at 336. Either liquid or gas can be heated by passing it through the tubing. Both, or two gases or two liquids, can be heated simultaneously, as for example by passing liquid through the tubing and gas around the heat sink plates and the exterior of the tubing. The tubing provides increased effective area. Preferably, the heat sink plates support the tubing. Welding components together is a preferred method of assembly. 360 is a bend.

Dimensions of the representative embodiment discussed may be:

rotor diameter: 15 in. (38 cm);
rotor steel back plate thickness: $\frac{3}{8}$ inch (9 mm);
rotor stainless steel (front) plate thickness: 1/16 in. (15 mm);
magnet length: 2 in. (5 mm);
magnet diameter: 4 in. (10 cm);
spacing between rotor and heat absorber plate: $\frac{1}{8}$ in. (3 mm);
heat absorber plate size: 16 by 16 by $\frac{1}{4}$ inch (40 by 40 by 6 mm);
ferro-magnetic plate size: 16 by 16 by 3/16 inch (40 by 40 by 4.8 mm);
number of heat sinks used: 33
heat sink plate height: $13\frac{3}{4}$ in. (35 l cm);
heat sink plate thickness: 1/16 inch (1.6 mm);
heat sink plate spacing on centers: approximately $\frac{1}{2}$ inch (13 mm);
heat sink plate length, embodiment 10: 6 inches (15 cm);
heat sink plate length, embodiment 300: 3 inch (7.5 cm);
copper tubing outside diameter: 1 inch (2.5 cm);
copper tubing inside diameter: $\frac{7}{8}$ inch (2.4 cm)
stainless steel shaft diameter: 1 inch (2.5 cm)

Speed of rotation tried has been from 1350 to 3600 rpm, the faster the hotter.

The magnets used were of the ceramic type, bought from surplus.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a system for heating fluid through means for transferring heat to fluid by rotation of elongate magnets arranged in a circular array adjacently to the means for transferring heat, with every other magnet oriented to have opposite polarity from the magnets adjacent thereto, the improvement comprising the means for transferring heat including: a plenum, a plurality of heat-sinks in said plenum, each of said heat sinks having first and second end portions, a ferro-magnetic plate, a heat absorber plate, the plurality of heat-sinks being integral at the first end portions with the heat absorber plate and passing through respective apertures in the ferro-magnetic plate to respective second end portions of the heat sinks in the plenum, and means for passing fluid through said plenum, for transfer of heat thereto.

2. In a system as recited in claim 1, the heat sinks comprising heat sink plates.

3. In a system as recited in claim 2, the heat sink plates being parallel to each other.

4. In a system as recited in claim 2, the heat sink plates and the heat absorber plate being of copper.

5. In a system as recited in claim 1, the heat sinks including a plurality of parallel plates having adjacent free ends, and tubing with a plurality of straight runs and "U"-shaped curves forming sinusoidal convolutions affixed to the plurality of parallel plates.

6. In a system as recited in claim 5, a respective said straight run affixed in intimate thermal contact along each parallel plate.

7. In a system as recited in claim 5, said heat absorber plate, heat sinks and tubing being of copper.

* * * * *